US008961235B2

(12) United States Patent
Little et al.

(10) Patent No.: US 8,961,235 B2
(45) Date of Patent: Feb. 24, 2015

(54) ELECTRICAL CONNECTOR WITH IMPROVED MATING MEMBER HAVING ANTI-MISMATING PORTION FOR PREVENTING INCORRECT INSERTION

(71) Applicant: Hon Hai Precision Industry Co., Ltd., New Taipei (TW)

(72) Inventors: Terrance F. Little, Fullerton, CA (US); An-Jen Yang, Irvine, CA (US); Chien-Ping Kao, Hershey, PA (US); Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 200 days.

(21) Appl. No.: 13/656,607

(22) Filed: Oct. 19, 2012

(65) Prior Publication Data

US 2014/0113481 A1 Apr. 24, 2014

(51) Int. Cl.
*H01R 24/00* (2011.01)

(52) U.S. Cl.
USPC ..... 439/660; 439/374

(58) Field of Classification Search
USPC ..... 439/660, 374, 357, 358
See application file for complete search history.

(56) References Cited

U.S. PATENT DOCUMENTS

| | | | | |
|---|---|---|---|---|
| 5,876,248 | A * | 3/1999 | Brunker et al. | 439/607.08 |
| 6,257,914 | B1 * | 7/2001 | Comerci et al. | 439/357 |
| 6,413,112 | B2 * | 7/2002 | Semmeling et al. | 439/358 |
| 6,575,789 | B2 * | 6/2003 | Bassler et al. | 439/607.23 |
| 7,674,118 | B2 | 3/2010 | He | |
| 7,845,965 | B2 * | 12/2010 | Ko | 439/352 |
| 8,118,497 | B2 * | 2/2012 | Yi | 385/93 |
| 8,684,769 | B2 * | 4/2014 | Kao et al. | 439/607.28 |

* cited by examiner

*Primary Examiner* — Xuong Chung Trans
(74) *Attorney, Agent, or Firm* — Wei Te Chung; Ming Chieh Chang

(57) ABSTRACT

An electrical connector includes a first insulative housing defining a base member and a mating member extending forwardly from the base member in a mating direction, and a plurality of first contacts retained in the first housing. The mating member defines opposite first and second mating faces in a vertical direction perpendicular to said mating direction, and a receiving portion recessed towards the first mating face from the second mating face thereof. The receiving portion cooperates with a corresponding portion of a mating connector for preventing incorrect insertion of the electrical connector.

20 Claims, 9 Drawing Sheets

ELECTRICAL CONNECTOR WITH IMPROVED MATING MEMBER HAVING ANTI-MISMATING PORTION FOR PREVENTING INCORRECT INSERTION

FIELD OF THE INVENTION

The present invention relates generally to an electrical connector, and more particularly to an electrical connector having a mating member with a recessed portion thereof for preventing incorrect insertion.

DESCRIPTION OF THE RELATED ART

A connector capable of transmitting high-speed differential signals is used as an interface connector or an internal connector of a digital appliance or a PC. U.S. Pat. No. 7,674,118 issued to He on Mar. 9, 2010 discloses such an electrical connector including an insulative housing and a plurality of contacts retained in the housing. The housing defines a base portion and a mating tongue extending forwardly from the base portion, the plurality of contacts define contacting portions respectively disposed at two opposite mating faces of the mating tongue. The mating tongue defines two raised portions respectively projecting from two opposite sides thereof for preventing incorrect insertion of an improper mating connector. However, each raised portion extends beyond the mating face, which enhanced the height of the mating tongue and is not suitable for miniaturization.

Hence, a new design which can prevent incorrect insertion and has a compact size is required.

SUMMARY OF THE INVENTION

Accordingly, an object of the present invention is to provide an electrical connector with a mating member having a recessed portion for cooperating with a corresponding portion of a mating connector for preventing incorrect insertion of the electrical connector.

In order to achieve the object set forth, an electrical connector includes a first insulative housing defining a base member and a mating member extending forwardly from the base member in a mating direction, a plurality of first contacts retained in the first housing, and a metal shell enclosing the housing to form a mating cavity. The mating member is disposed in the mating cavity and defines opposite first and second mating faces in a vertical direction perpendicular to said mating direction, the plurality of first contacts include contacting sections exposed upon the opposite first and second mating faces. The mating member defines a receiving portion recessed towards the first mating face from the second mating face thereof, and a supporting face is provided in the receiving portion and disposed in a plane different from the second mating face.

Other objects, advantages and novel features of the invention will become more apparent from the following detailed description of the present embodiment when taken in conjunction with the accompanying drawings.

DETAILED DESCRIPTION OF THE INVENTION

Figure 1:
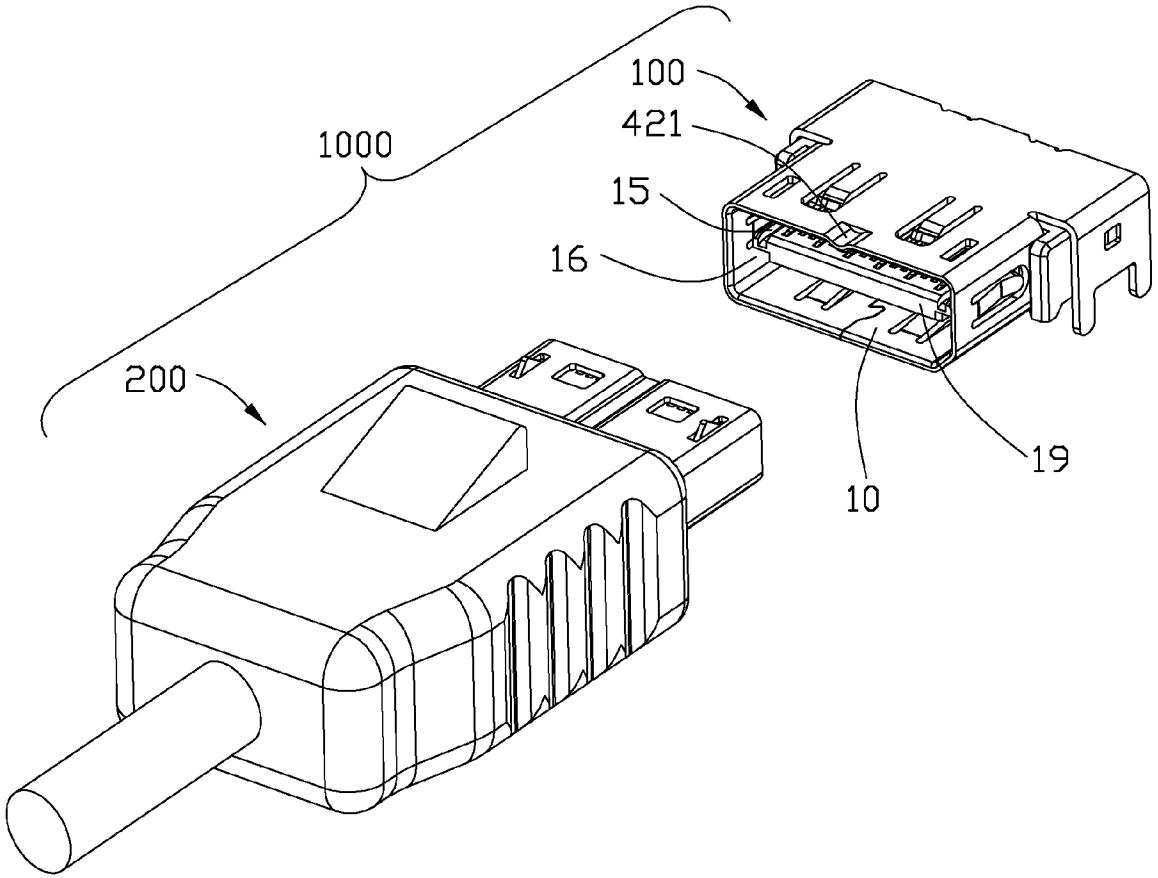
FIG. 1 is an assembled, perspective view of an electrical connector assembly including an electrical connector and a mating connector disconnecting from each other in accordance with the present invention.

Reference will now be made to the drawing figures to describe a preferred embodiment of the present invention in detail.

Figure 2:
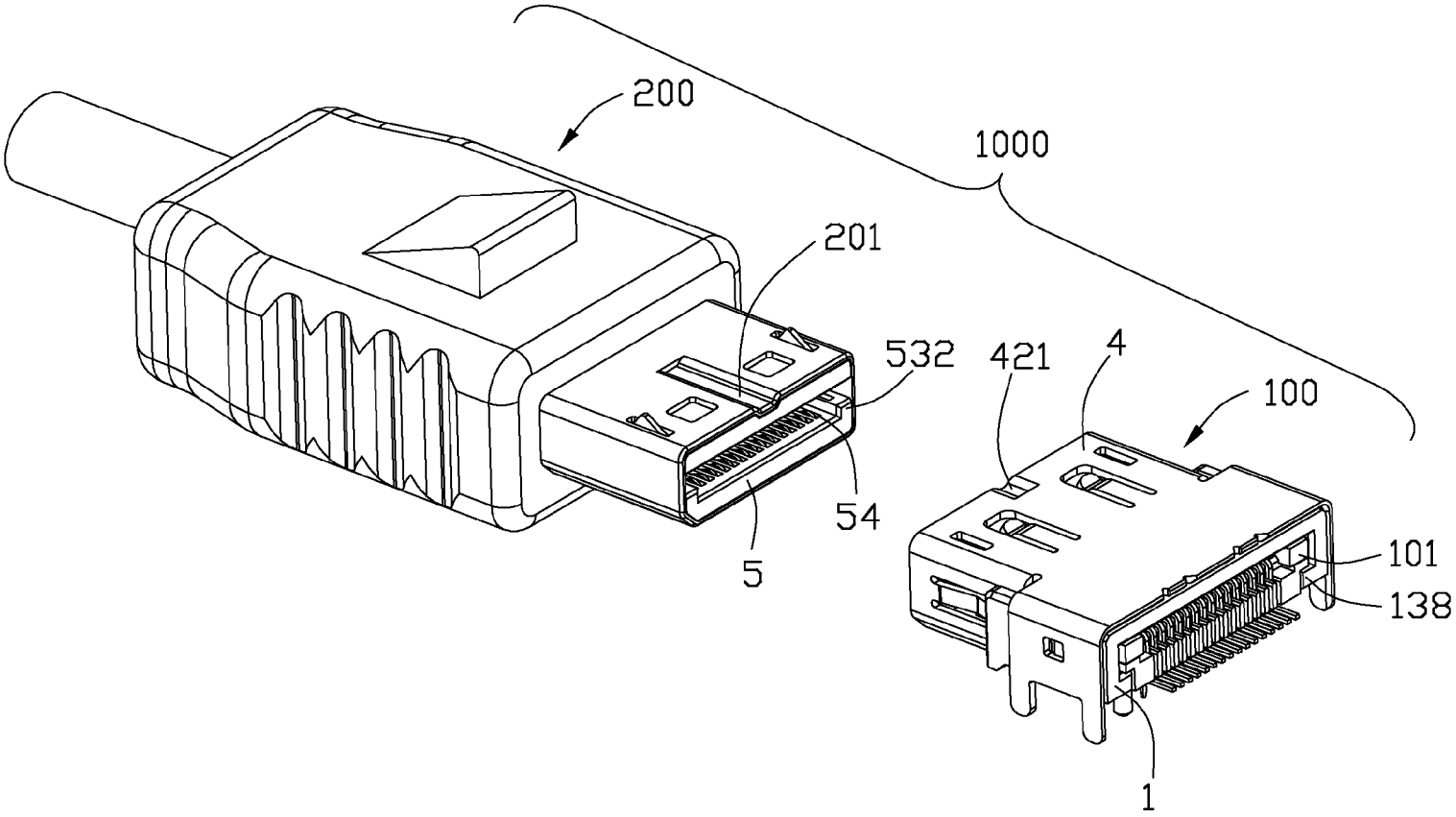
FIG. 2 is another perspective view of the electrical connector assembly shown in FIG. 1.

Referring to FIGS. 1 and 2, an electrical connector assembly 1000 in accordance with the present invention includes an electrical connector 100 to be mounted onto a printed circuit board and a mating connector 200 intended to mate with the electrical connector 100.

Figure 3:
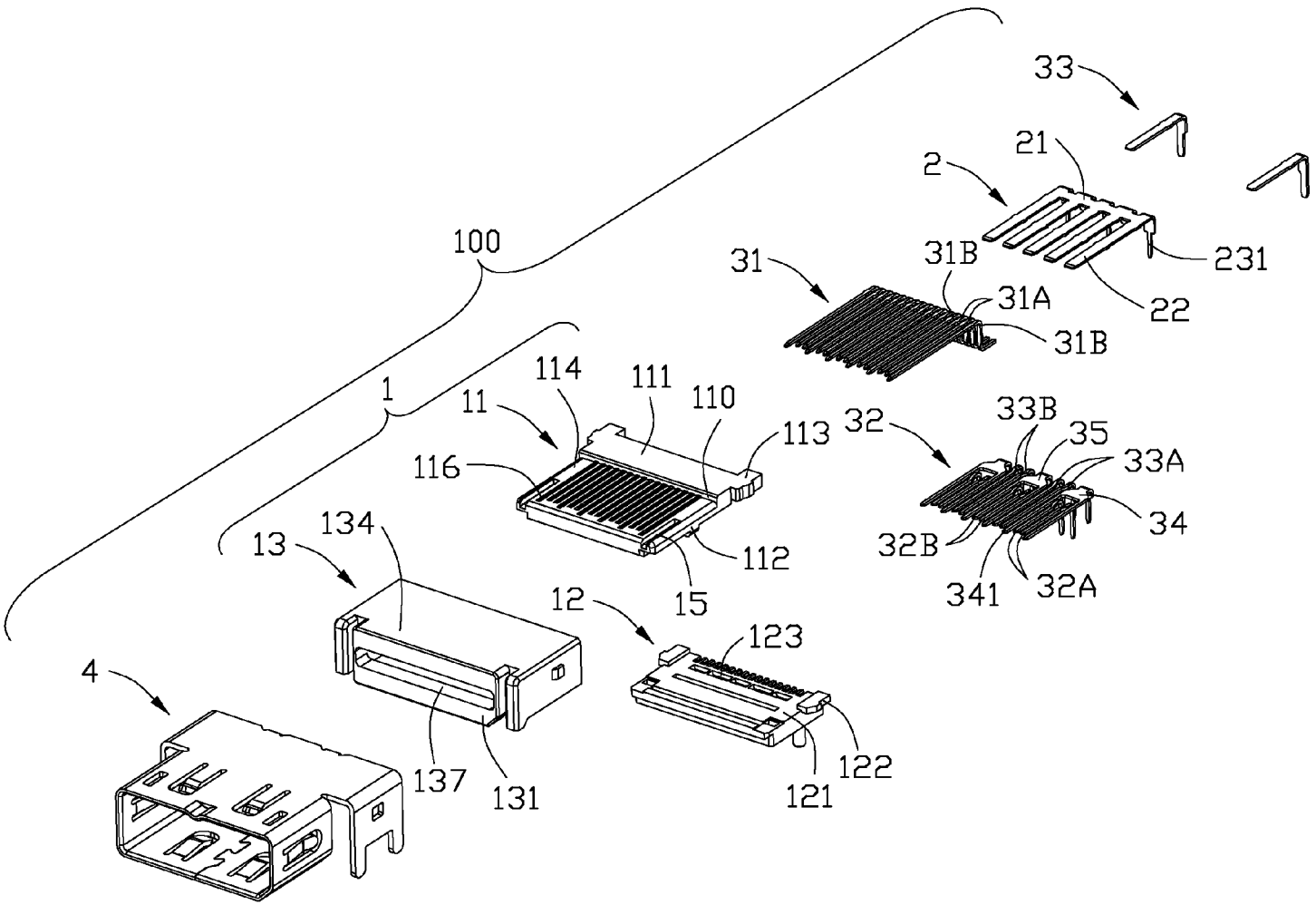
FIG. 3 is an exploded perspective view of the electrical connector shown in FIG. 1.
Figure 4:
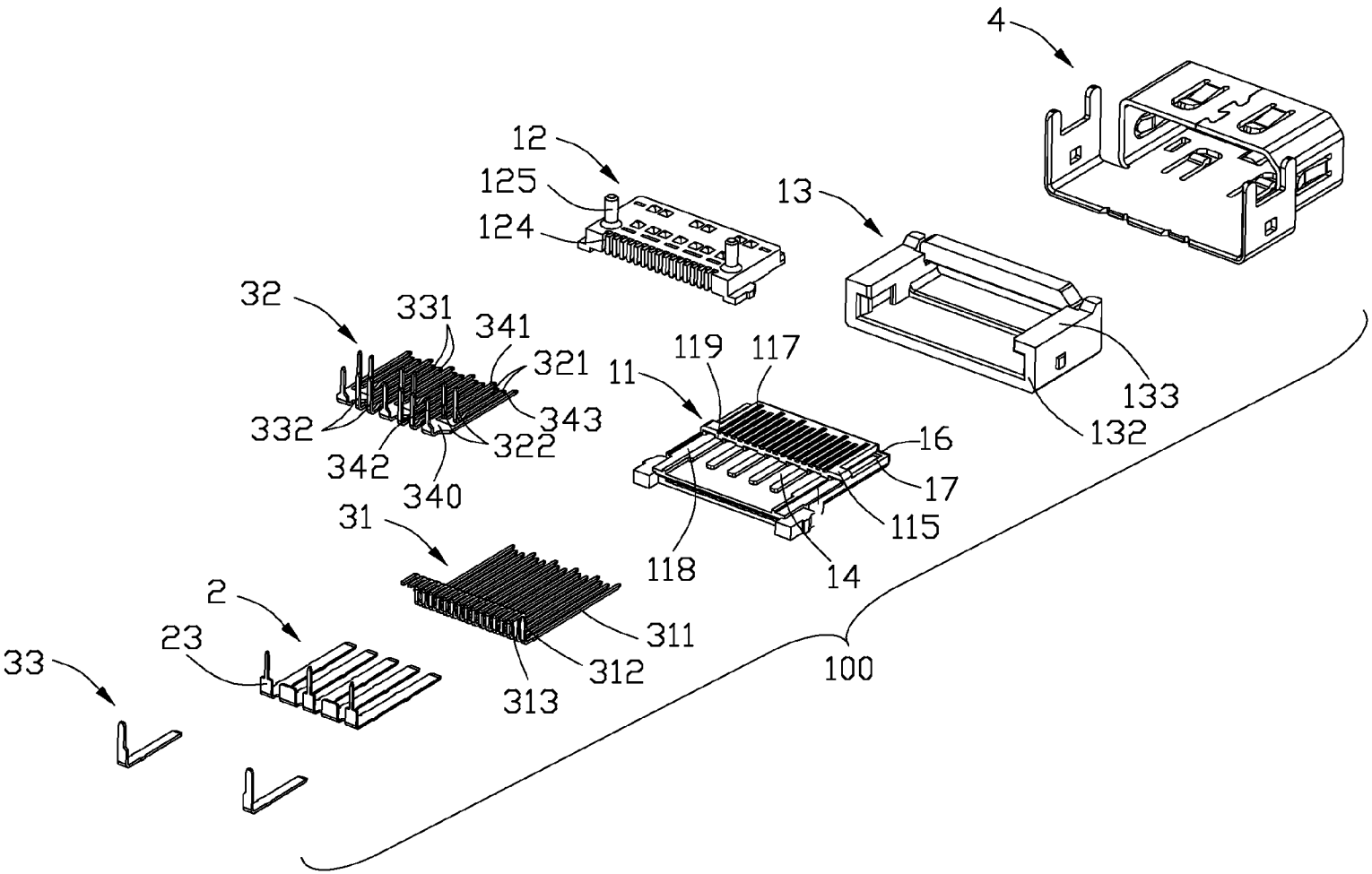
FIG. 4 is another exploded perspective view of the electrical connector shown in FIG. 3.

Referring to FIGS. 2 to 4, the electrical connector 100 mainly includes a first insulative housing 1, a first grounding plate 2 retained in the first housing 1, a plurality of first contacts retained in the first housing 1 and disposed at two opposite sides of the first grounding plate 2, and a metal shell 5 surrounding the first housing 1.

The first housing 1 includes an upper member 11, a lower member 12 engaging with the upper member 11 and an insulative bracket 13 retained to the upper and lower members 11, 12. The upper member 11 defines a first base portion 111 and a mating portion 112 extending from the first base portion 111 along a mating direction with a stopping face 110 formed therebetween, the first base portion 111 defines two protrusions 113 rearward and outwardly extending from opposite two rear sides thereof, the mating portion 112 defines opposite first mating face 114 and second mating face 115 in a vertical direction perpendicular to the mating direction. A plurality of first receiving slots 116 is disposed upon the first mating face 114 and further run through the first base portion 111 in the mating direction, a plurality of second receiving slots 117 is disposed upon the second mating face 115 at a front portion thereof. The upper member 11 defines a receiving room 118 at a rear portion to be disposed behind the second receiving slots 117 and provides a step portion 119 at the mating portion 112. The receiving room 118 further defines five receiving passages 14 running into the mating portion 112 and disposed between the first mating face 114 and the second mating face 115.

The mating portion 112 defines two receiving slots 15 recessed in the first mating face 114 and disposed at two outermost sides of the first receiving slots 116 for receiving a deformed latch member in the mating connector 200 while which mates with the electrical connector 100. The mating portion 112 defines two receiving portions 16 each recessed toward the first mating face 114 from the second mating face 115 thereof, the receiving portions 16 are arranged at two outmost sides of the second receiving slots 116 for anti-mismating and provides a supporting face 17 disposed in a plane different from the second mating face 115. The mating portion 112 defines a front face connecting with the first and second mating faces 115, 116 at a front edge thereof, and a side face connecting with the front face, the first mating face and the second mating face, each receiving portion 16 runs through the front face and the side face. Each receiving portion 16 stacks with a corresponding receiving slot 15 in the vertical direction.

The lower member 12 defines a main body portion 121 and two supporting portions 122 respectively extending outwards from two opposite sides of the main body portion 121 at an upper rear portion thereof, five through holes 123 run through the main body portion 121 in the vertical direction and arranged in a longitudinal direction. The main body portion 121 further defines a plurality of retaining slots 124 recessed from a rear face thereof and two retaining posts 125 extending downwardly from two outer sides of a bottom face thereof.

Referring to FIGS. 3 to 6, the first grounding plate 2 defines a board-shaped first base plate 21, five first shielding arms 22 extending forward from a front end of the first base plate 21, and five connecting portions 23 corresponding to the five first shielding arms 22 bending downwardly from a rear end of the first base plate 21. Three connecting legs 231 extend downwardly respectively from the first, third and fifth shielding arms 22. The five first shielding arms 22 are disposed at a same plane. The first grounding plate 2 is received in the receiving room 118 with the first shielding arms 22 forwardly inserted into the corresponding receiving passages 14 and disposed between the first and second mating faces 114, 115.

The plurality of first contacts includes a set of first upper contacts 31, a set of first lower contacts 32, and a pair of first power contacts 33. The set of first upper contacts 31 includes four pairs of upper differential pairs 31A for signal transmission and five upper grounding contacts 31B located at two opposite sides of the upper differential pairs 31A. The upper differential pairs 31A and the upper grounding contacts 31B have similar configuration and each includes an upper blade contacting section 311, a restricting portion 312 bending downwardly from a rear end of the upper contacting section 311 and a first terminal portion 313 bending rearwards from the restricting portion 312. The upper contacting sections 311 are disposed in a same plane; the first terminal portions 313 are also disposed in a same plane and arranged in one row for surface mounting. The set of upper contacts 31 are forwardly assembled into the first receiving slots 116 with the upper contacting sections 311 expose upon the first mating face 114, and the restricting portions 312 are disposed behind the connecting portions 23. The first power contacts 33 each is retained in the mating portion 112 with a contacting section 331 disposed in the receiving portions 16 and exposed upon the supporting face 17.

The set of first lower contacts 32 includes four pairs of lower differential pairs 32A, 33A, 32B and 33B arranged in a longitudinal direction for signal transmission and first and second lower grounding contacts 34, 35 having similar configuration, the set of lower contacts 32 are inserted molding in the lower member 12. The first lower differential pairs 32A and the third lower differential pairs 32B have similar configuration, the second lower differential pairs 33A and the fourth lower differential pairs 33B have similar configuration. The first or third lower differential pairs 32A or 32B each defines a first terminal portion 322 and a first contacting section 321, the second or fourth lower differential pairs 33A or 33B each defines a second terminal portion 332 and a second contacting section 331. Each lower grounding contact 34/35 defines a base plate 340, a tail section 342 bending downwardly from a rear end of the base plate 340, and two grounding arms 341, 343 extending forwardly from two opposite sides of a front end of the base plate 340. The first contacting sections 321, the second contacting sections 331, and the first and second grounding arms 341, 343 are disposed in a same plane and arranged in one row with one grounding arm 341/343 disposed between every adjacent two lower differential pairs.

Figure 5:
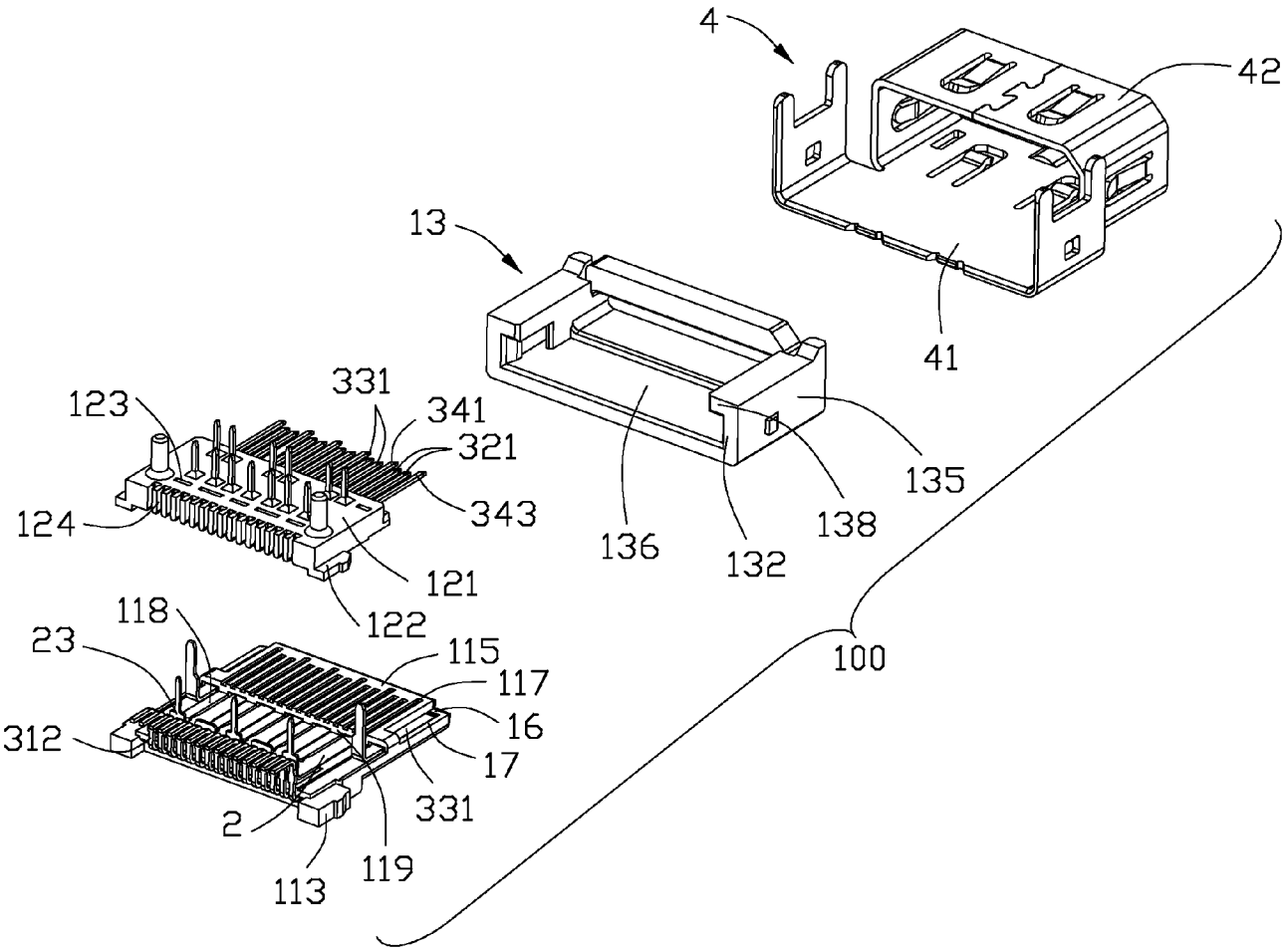
FIG. 5 is a partly exploded perspective view of the electrical connector and shows an insulative bracket and a metal shell separated from the upper member and the lower member shown in FIG. 4.
Figure 6:
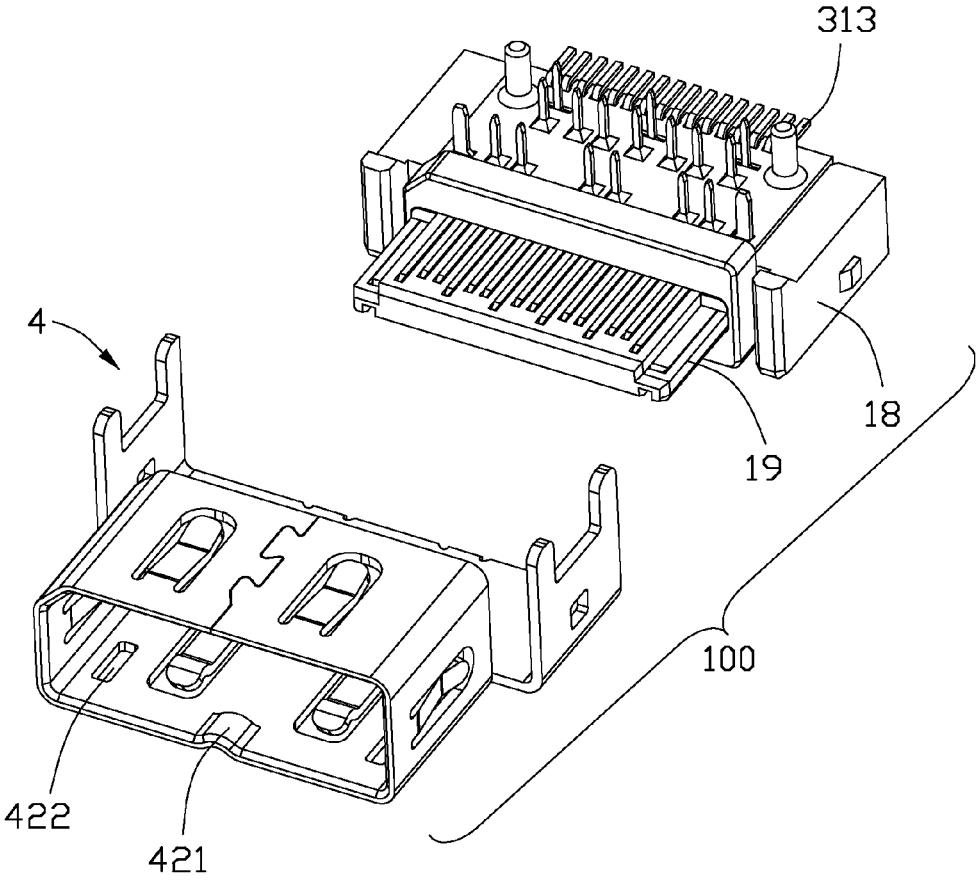
FIG. 6 is partly exploded view of the electrical connector and shows the metal shell separated from the first housing shown FIG. 4.

Referring to FIGS. 2 and 5, the lower member 12 retaining the set of lower contacts 32 is upwardly assembled to the upper member 11. The main body portion 121 is received in the receiving room 118 and abuts against the step portion 119, and the supporting portions 122 upwardly abut against the protrusions 113 to be defined as hooking portions 101. The first contacting sections 321, the second contacting sections 331, and the first and second grounding arms 341, 343 are received in corresponding second receiving slots 117 and expose upon the second mating face 115. The connecting portions 23 are received in the through holes 123 with the connecting legs 231 running therethrough, and the restricting portions 312 retained in the retaining slots 124. The first grounding plate 2 is disposed between the set of first upper contacts 31 and the set of first lower contacts 32 for improved impedance. The second terminal portions 332 and tail sections 342 of the first lower contacts 32 are configured for through hole mounting.

Referring to FIG. 2 to FIG. 6, the bracket 13 defines a front face 131, a rear face 132 opposite to the front face 131, a bottom face 133 defined as a fixing face, a top face 134 facing to the bottom face 133, and a pair of sidewalls 135 connecting with the bottom and top faces 133, 134. A receiving portion 136 is recessed rearwards from the front face 131 to run through the rear face 132 and a rear portion of the bottom face 133, and the receiving portion 136 provides an opening 137 at the front face 131 thereof. The sidewalls 135 each provides a platform 138 extending towards the receiving portion 136 from an inner face of the sidewall 135. The upper member 11 assembled with the lower member 12 is inserted into the receiving portion 136 from the rear face 132 of the bracket 13 and retained in the receiving portion 136 by the hooking portions 101 supported by the corresponding platforms 138 and locking with the sidewalls 135. The mating portion 112 forwardly extends out of the receiving portion 136 from the opening 137 thereof. The first base portion 111 retaining with the main body portion 121 and the bracket 4 is defined as a base member 18 of the first connector 100, and the mating portion 112 is defined as a mating member 19 of the first connector 100.

The metal shell 4 defines a shielding portion 41 surrounding the bracket 13, and a mating frame 42 connecting with the shielding portion 41. The metal shell 4 is assembled rearwards from the front face 131 of the bracket 13, the shielding portion 41 surrounds the bracket 13, and the mating frame 42 surrounding the mating member 17 to form a mating cavity 10. The mating frame 42 defines a guiding portion 421 projecting into the mating cavity 10 and a pair of latching holes 422 respectively disposed at two sides of the guiding portion 421.

Figure 7:
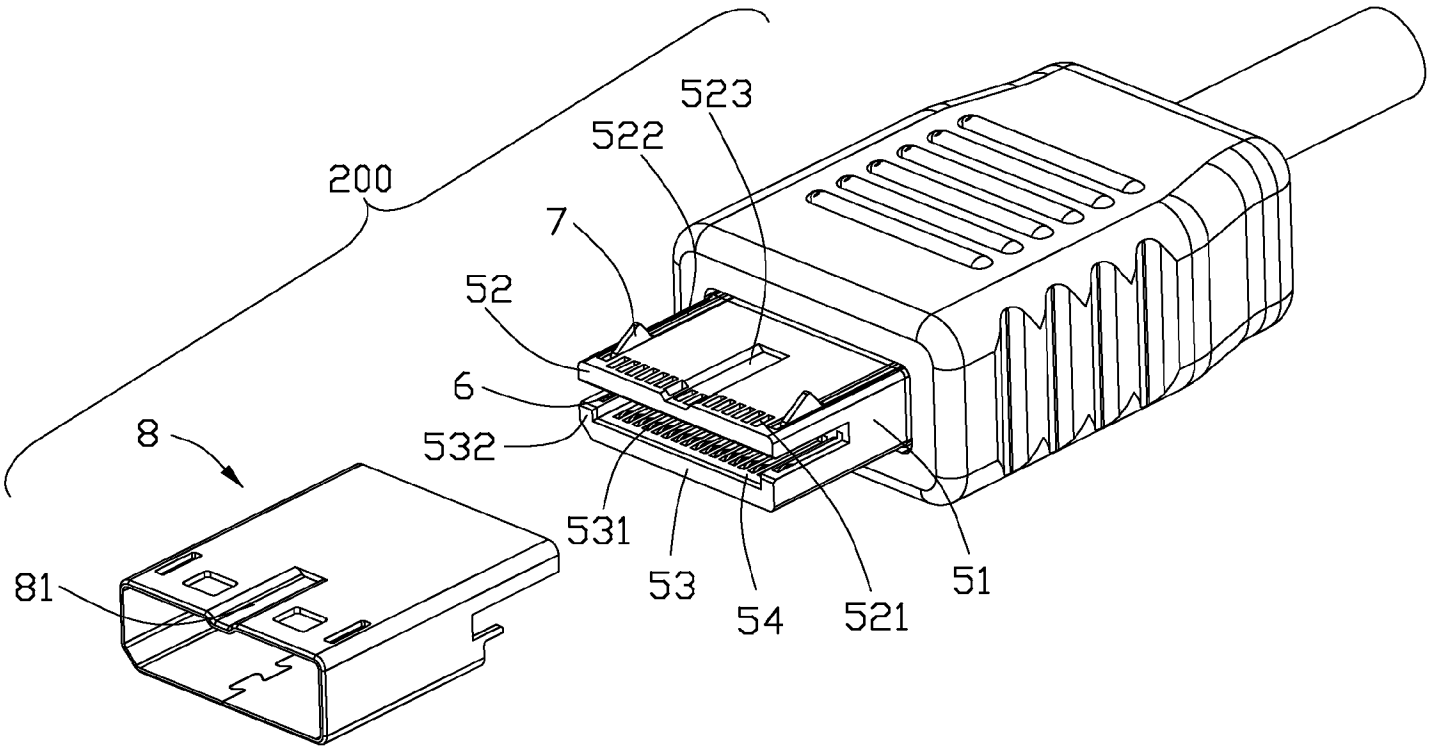
FIG. 7 is a partly exploded perspective view of the mating connector shown in FIG. 1.

Referring to FIGS. 1, 2 and 7, the mating connector 200 includes a second insulative housing 5, a plurality of second contacts retained in the second housing 5, a pair of latch members 7 retained in the second housing 5, and a second metal shell 8 shielding the second housing 5.

The second housing 5 defines a second base portion 51, a first tongue portion 52 and a second tongue portion 53 oppositely extending forward from the second base portion 51, and a mating room 54 disposed between the first and second tongue portions 52, 53. The first tongue portion 52 defines a plurality of first receiving grooves 521 communicating with the mating room 54 and further run through the second base portion 51. The first tongue portion 52 further defines a pair of latching slots 522 disposed at two sides of the first receiving grooves 521 and a recess portion 523 disposed at a middle portion of an outer surface thereof. The latching slots 522 run through the first tongue portion 52 in the vertical direction, and the resilient latching member 7 is received in the latching slot 522 with a locking portion projecting out of the latching slot 522.

The second tongue portion 53 defines a plurality of second receiving grooves 531 communicating with the mating room 54 and further run through the second base portion 51. The second tongue portion 53 defines a pair of projecting portion 532 raised into the mating room 54 from an inner face thereof, the projecting portion 532 is disposed at two outermost sides of the second receiving grooves 531. The plurality of second contacts include a set of second upper contacts retained in the first receiving grooves 521, a set of second lower contacts retained in the second receiving grooves 531, and a pair of second power contacts 6 retained in the corresponding projecting portions 532. The second metal shell 8 covers outside of the second housing 5 for shielding, and provides a recess 81 matching with the recess portion 523 to form a guiding recess 201.

Figure 8:
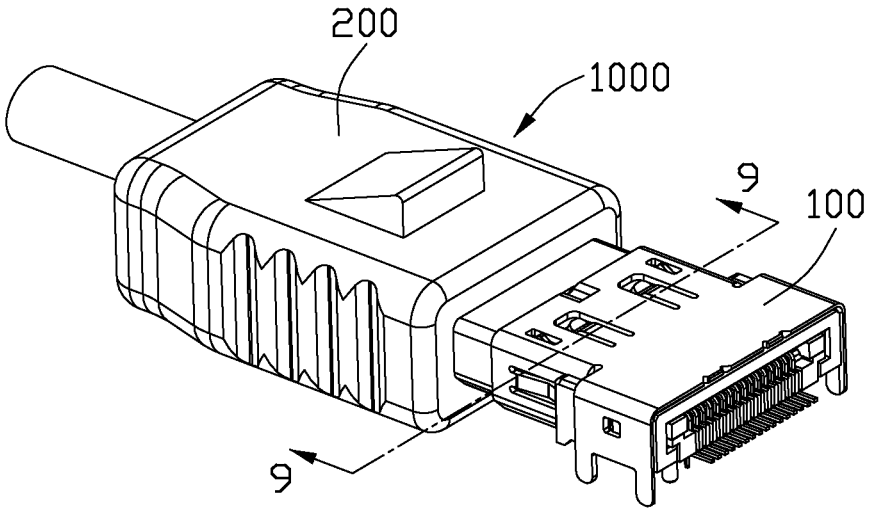
FIG. 8 is a perspective view of the electrical connector assembly shown in FIG. 1, showing the electrical connector is mated with the mating connector.
Figure 9:
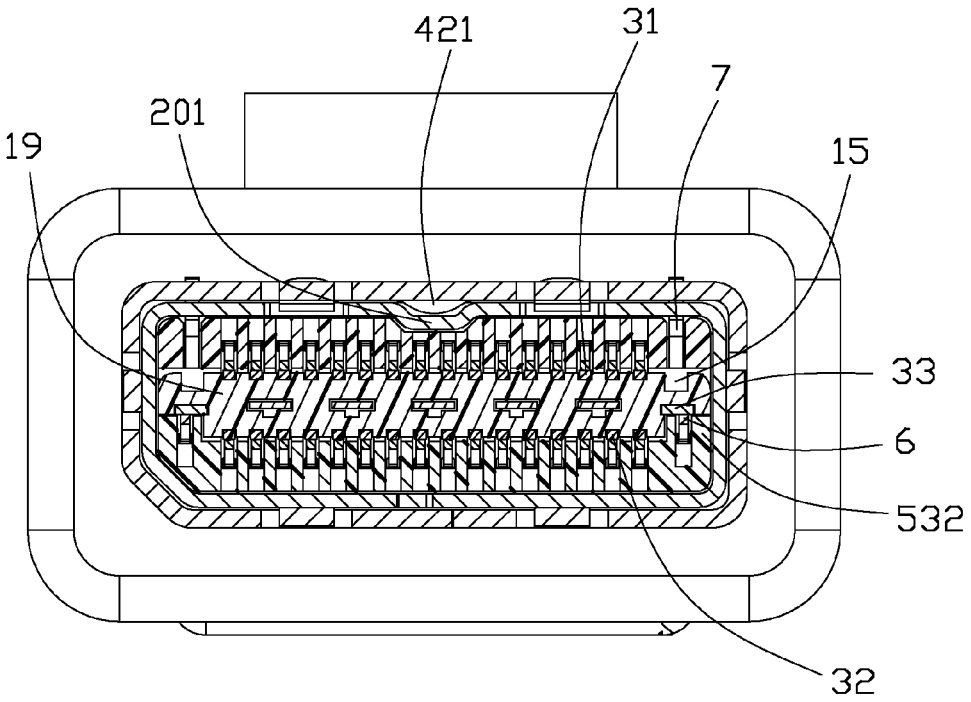
FIG. 9 is a cross-section view of the electrical connector assembly taken along line 9-9 of FIG. 8.

Referring to FIGS. 2, 8 and 9, the mating connector 200 is inserted into the mating cavity 10 with the guiding portion 421 cooperating with the guiding recess 201 and the mating member 19 received in the mating room 54. The set of first upper contacts 31 contact with the set of second upper contacts, the set of first lower contacts 32 contact with the set of second lower contacts. The projecting portions 532 projects into the receiving portions 16 to make the first power contacts 33 connecting with the second power contacts 6. The receiving slot 15 aligns with the latching member 7 for receiving the latching member 7 while which is deformed. The receiving portions 16 cooperate with the projecting portions 532 which can guide the electrical connector 100 mating with the mating connector 200 smoothly in correct manner, and the projecting portion 532 will be blocked by the mating member 19 when the receiving portion 16 is not align with the projecting portions 532 to prevent the incorrect insertion of the electrical connector assembly 1000.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a first insulative housing defining a base member and a mating member extending forwardly from the base member in a mating direction, the mating member defining opposite first and second mating faces in a vertical direction perpendicular to said mating direction;

a plurality of first contacts retained in the first housing and including a plurality of contacting sections exposed upon the opposite first and second mating faces; and a metal shell enclosing the housing to form a mating cavity, the mating member separately disposed in the mating cavity;

wherein the mating member defines a receiving portion recessed towards the first mating face from the second mating face thereof, and a supporting face is provided in the receiving portion and disposed in a plane different from the second mating face.

2. The electrical connector as described in claim 1, wherein the mating member defines a front face connecting with the first and second mating faces at a front edge thereof, and the recessed portion runs through the front face.

3. The electrical connector as described in claim 2, wherein the mating member defines a receiving slot recessed in the first mating face thereof, and the receiving portion stacks with the receiving slot in the vertical direction.

4. The electrical connector as described in claim 3, wherein the mating member defines a side face connecting with the front face, the first mating face and the second mating face, and the recessed portion runs through the side face.

5. The electrical connector as described in claim 4, wherein the metal shell defines a guiding portion projecting in to the mating cavity.

6. The electrical connector as described in claim 3, further defining a first power contact disposed in the recessed portion and exposed upon the supporting face.

7. The electrical connector as described in claim 1, wherein the plurality of contacts includes a set of first upper contacts arranged upon the first mating face, and a set of first lower contact arranged upon the second mating face; a first grounding plate is retained in the first housing and disposed between the set of first upper contacts and the set of first lower contacts.

8. The electrical connector as described in claim 7, wherein the set of first lower contacts are designated with differential pairs and grounding arms under condition that the grounding arms share a same tail section which is located behind those of the corresponding differential pairs sandwiched therebetween.

9. The electrical connector as described in claim 8, wherein the set of first upper contacts define first terminal portions configured for surface mounting while second terminal portions and tail sections of the first lower contacts are configured for through hole mounting.

10. An electrical connector assembly comprising:

an electrical connector including:

a first insulative housing defining a mating member extending in a front-to-rear direction and having opposite first and second mating faces in a vertical direction perpendicularly to the front-to-rear direction, the mating member defining a receiving portion recessed from the second mating face in the vertical direction;

a set of first upper contacts forwardly assembled to the first housing and arranged upon the first mating face in a longitudinal direction; and a set of first lower contacts assembled to the first housing in the vertical direction and arranged upon the second mating face in the longitudinal direction;

a mating connector mated with the electrical connector and including:

a second insulative housing having first and second tongue portions spaced from each other and providing a mating room disposed therebetween; and a plurality of second contacts respectively arranged in the first and second tongue portions;

the second tongue portion defining a projecting portion raised into the mating room from an inner face thereof for fitting into the receiving portion.

11. The electrical connector assembly as described in claim 10, wherein the mating member defines a front face connecting with the first and second mating faces at a front edge thereof, and the recessed portion runs through the front face.

12. The electrical connector assembly as described in claim 11, wherein the mating member defines a receiving slot recessed in the first mating face thereof, and the receiving portion stacks with the receiving slot in the vertical direction.

13. The electrical connector assembly as described in claim 10, wherein the first housing defines an upper member providing the opposite first and second mating faces and a lower member engaging with the upper member, and the set of first upper contacts is retained in the upper member, the set of first lower contacts is retained in the lower member.

14. The electrical connector assembly as described in claim 13, wherein the lower member defines a plurality of retaining slots recessed from a rear face thereof, and the set of first upper contacts define restricting portions retained in the corresponding retaining slots.

15. The electrical connector assembly as described in claim 10, wherein a first grounding plate is retained in the first housing and disposed between the set of first upper contacts and the set of first lower contacts.

16. The electrical connector assembly as described in claim 10, wherein the set of first lower contacts are designated with differential pairs and grounding arms under condition that the grounding arms share a same tail section which is located behind those of the corresponding differential pairs sandwiched therebetween.

17. An electrical connector assembly comprising:

a first connector for mounting to a printed circuit board, including:

an insulative first housing defining a mating tongue essentially extending in both a front-to-back direction and a lateral direction perpendicular to each other, and surrounded by a metallic first shell;

a plurality of first contacts disposed in the first housing with contacting sections exposed upon the mating tongue;

a pair of receiving slots formed around two opposite lateral ends of the mating tongue and facing toward the first shell in a vertical direction perpendicular to both said lateral direction and said front-to-back direction;

a pair of latching holes formed in the first shell and respectively aligned with the corresponding receiving slots in the vertical direction;

a second connector for connecting to a cable, including:

an insulative second housing defining a blade shaped receiving cavity extending along the lateral direction and the front-to-back direction;

a plurality of second contacts disposed in the second housing with contacting sections extending into the receiving cavity;

a pair of latches disposed around two opposite lateral ends of the receiving cavity and deflectable in the vertical direction; wherein when the first connector and the second connector are mated with each other, the mating tongue is received in the receiving cavity, and the latches are eventually received in the corresponding latching holes, respectively while being inwardly deflected to be respectively received in the corresponding receiving slots intermediately during inserting the mating tongue into the receiving cavity.

18. The electrical connector assembly as claimed in claim 17, wherein the mating tongue defines a pair of receiving portions located around said two lateral ends and respectively opposite to the pair of receiving slots in the vertical direction and respectively equipped with a pair of first power contacts, and the second housing forms a pair of steps located around the corresponding opposite lateral ends to be received in said pair of receiving portions and respectively equipped with a pair of second power contacts to mechanically and electrically connected to the corresponding pair of first power contacts, respectively.

19. The electrical connector assembly as claimed in claim 17, wherein said receiving cavity extends through the housing in the lateral direction so as to have the mating tongue to directly confront the second shell in the lateral direction.

20. The electrical connector assembly as claimed in claim 17, wherein said pair of latches extend outwardly through the second shell to reach an exterior, and inward through the housing to reach the receiving cavity.

* * * * *